US008936188B2

(12) United States Patent
Mazurek

(10) Patent No.: US 8,936,188 B2
(45) Date of Patent: Jan. 20, 2015

(54) PACKAGE WITH SLEEVE AND INTERLOCKING, SLIDE-IN INSERT

(75) Inventor: Richard Mazurek, Huntingdon Valley, PA (US)

(73) Assignee: HLP Clear Packaging Products (USA), Inc., Torrance, CA (US)

( * ) Notice: Subject to any disclaimer, the term of this patent is extended or adjusted under 35 U.S.C. 154(b) by 532 days.

(21) Appl. No.: 13/316,405

(22) Filed: Dec. 9, 2011

(65) Prior Publication Data

US 2012/0152766 A1 Jun. 21, 2012

Related U.S. Application Data

(60) Provisional application No. 61/424,378, filed on Dec. 17, 2010, provisional application No. 61/483,278, filed on May 6, 2011.

(51) Int. Cl.
*B65D 5/38* (2006.01)

(52) U.S. Cl.
CPC ..... *B65D 5/38* (2013.01); *Y10S 229/913* (2013.01)
USPC ..... 229/125.125; 206/1.5; 229/128; 229/913

(58) Field of Classification Search
USPC ..... 229/125.125, 128, 913
See application file for complete search history.

(56) References Cited

U.S. PATENT DOCUMENTS

| | | | | |
|---|---|---|---|---|
| 2,426,856 | A * | 9/1947 | Berg | 229/125.125 |
| 3,648,918 | A * | 3/1972 | Van Inwagen | 229/125.125 |
| 7,377,385 | B2 * | 5/2008 | Giannini et al. | 229/125.125 |
| 7,389,875 | B2 * | 6/2008 | Sandberg et al. | 229/125.125 |
| 8,668,103 | B2 * | 3/2014 | Zeiss | 229/122 |
| 2006/0131205 | A1 * | 6/2006 | Sandberg et al. | 206/538 |
| 2007/0181458 | A1 * | 8/2007 | Ehrlund | 206/528 |
| 2010/0133123 | A1 * | 6/2010 | Thibault | 206/1.5 |
| 2012/0261275 | A1 * | 10/2012 | Intini | 206/1.5 |

* cited by examiner

*Primary Examiner* — Gary Elkins
(74) *Attorney, Agent, or Firm* — Jacobs & Kim LLP; Daniel Kim, Esq.

(57) ABSTRACT

A package has a sleeve and an insert that lock together. The insert has a longitudinal flange on one side that fits into a corresponding longitudinal channel in the sleeve. The sleeve includes a locking tab in line with the longitudinal channel that is foldable into the sleeve to present a deflectable contact edge across the longitudinal channel. Engagement of the locking tab contact edge with a shoulder on the longitudinal flange prevents movement of the insert in the direction of the locking tab. The insert can be locked in both a forward and a backward direction within the sleeve by providing respective locking tabs and shoulders at both ends of the package.

13 Claims, 15 Drawing Sheets

FIG. 15A
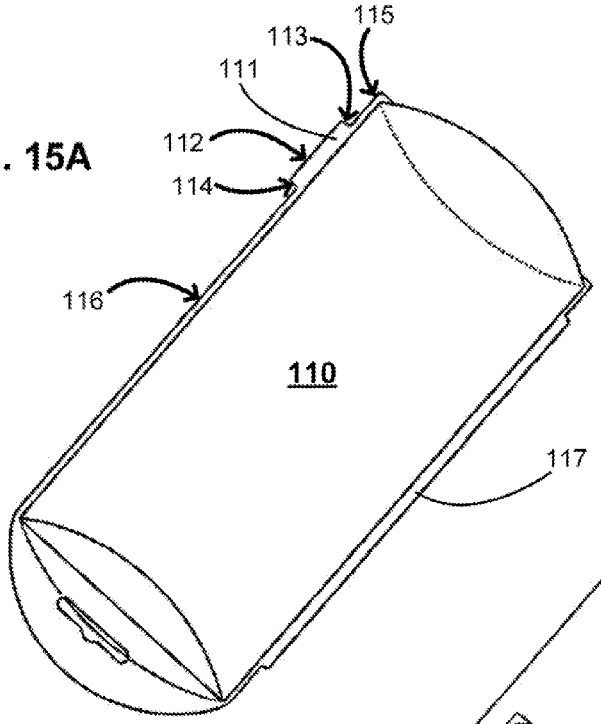
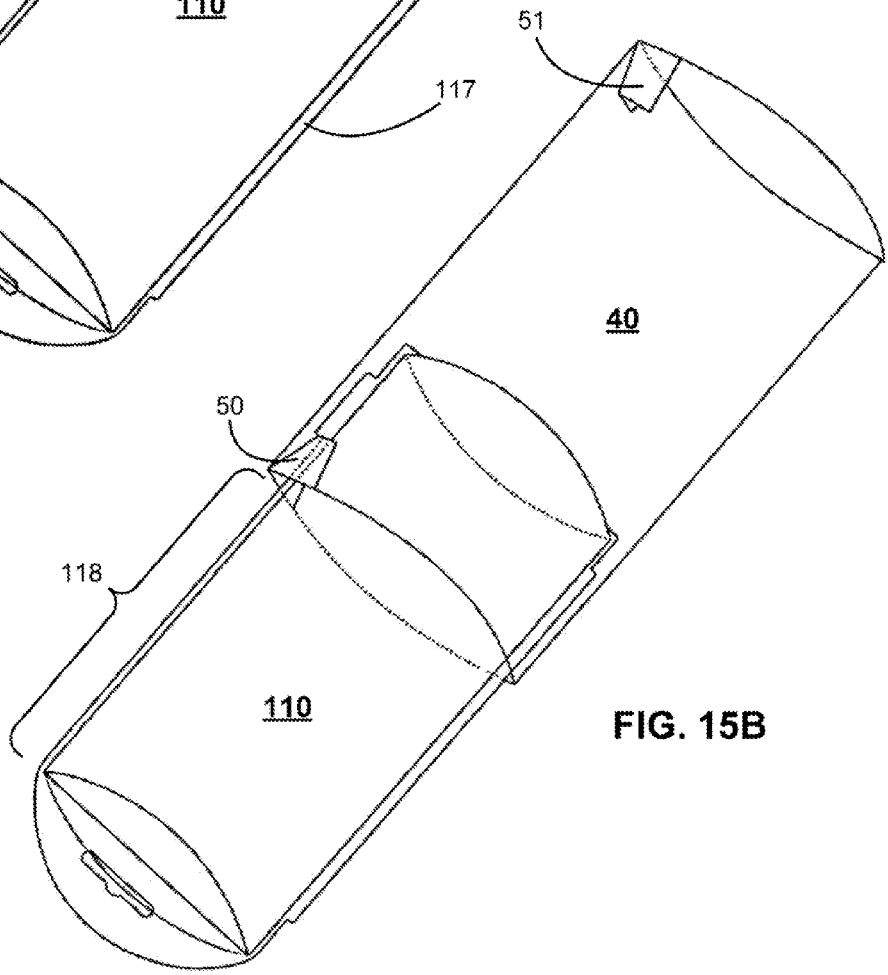
FIG. 15B

PACKAGE WITH SLEEVE AND INTERLOCKING, SLIDE-IN INSERT

CROSS REFERENCE TO RELATED APPLICATIONS

The present application claims the priority benefit of the following documents:

U.S. Provisional Patent Application Ser. No. 61/424,374, filed on Dec. 17, 2010.

U.S. Provisional Patent Application Ser. No. 61/483,278, filed on May 6, 2011.

BACKGROUND OF THE INVENTION

1. Field of the Invention

The present invention relates generally to the field of product packaging, and in particular to an improved package with a sleeve and interlocking slide-in insert.

2. Prior Art

Product packaging is a highly competitive industry, in which there is an ongoing effort to develop new package designs. A successful design must typically satisfy a number of often conflicting criteria, including: security, esthetic appearance, cost, ease of use, and the like. With respect to cost, it is noted that even a relatively small per-package savings in materials or labor can have a significant impact on the bottom line.

One commonly used type of design is the so-called "sleeve-and-insert" package. This type of package includes two basic components that are assembled together: (1) an insert having a compartment, cavity, or other structure for holding an item to be packaged and (2) an outer sleeve that fits over the insert. A sleeve-and-insert package is typically assembled by loading the item into the insert and then loading the insert into an open end of the sleeve.

Typically, the assembled package is secured in some way to hold the sleeve in position over the insert. Securing the assembled package serves a number of purposes, including prevention of damage to the package or its contents, as well as prevention of theft or tampering. One common technique for holding the sleeve in place is to apply adhesive tape, labels, or shrink wrap to the exterior of the assembled package.

It will be appreciated that securing a package in this way suffers from a number of disadvantages. Applying a securing material to a package after assembly adds a step to the process, and incurs costs for labor, equipment, and materials. In addition, adhesive tape, labels, or shrink wrap can detract from the overall esthetic appearance of a package.

Some prior art sleeve-and-insert package have attempted to address the above issues by designing the insert and sleeve to include respective structures that lock together when the insert is assembled into the sleeve. For example, in one such package design, a sleeve is provided with foldable tabs that interlock with respective indentations in an insert. However, this type of package has not proven to be entirely satisfactory. If the sleeve tabs and insert indentations lack sufficient rigidity, the resulting locking action will be insecure. Achieving the necessary rigidity may require the use of heavier materials or reinforcement structures, thereby adding to the overall cost of the package. In addition, the prior-art design limits the number of available cross sectional shapes for the package, because of the need to make sure that the tabs are properly seated in their respective indentations and cannot be easily pulled or twisted out of position. Thus, prior art designs have left a significant amount of room for improvement with respect to these and other criteria.

SUMMARY OF INVENTION

An aspect of the invention provides a package comprising an interlocking sleeve and insert. The insert is provided with one or more longitudinally extending flanges. Each flange includes one or more shoulders. The sleeve has at least one open end for receiving the insert, which fits closely within the sleeve. The sleeve includes one or more longitudinal channels that extend along the side of the sleeve, and that provide one or more respective longitudinal paths along which the one or more flanges travel when the insert is loaded into the sleeve. One or more respective locking tabs extend from the sleeve in line with the one or more longitudinal channels. The one or more locking tabs are foldable into the sleeve to present one or more respective contact edges that extend across the one or more longitudinal paths. The insert is loadable into the sleeve to a position in which the one or more flange shoulders are engageable with respective contact edges of the one or more locking tabs, so as to prevent movement of the insert in the respective directions of the one or more locking tabs. Thus, a sleeve-and-insert package can be locked in both a forward and a backward direction by providing respective flange shoulders and locking tabs at both ends of the package. Alternatively, a package can be locked in a single direction by providing one or more flange shoulders and locking tabs at only one end of the package.

Another aspect of the invention is directed to techniques for constructing inserts and sleeves having the described flanges and locking tabs. A further aspect of the invention is directed to a locking sleeve-and-insert package in which the sleeve is provided with a breakaway section that allows the removal of one or more locking tabs, thereby at least partially disabling the described locking action.

BRIEF DESCRIPTION OF THE DRAWINGS

FIG. 15A shows a perspective view of an insert, similar to the insert shown in FIG. 1, that has been provided with a longitudinal flange having shoulders that are spaced relatively closely together towards one end of the insert; FIG. 15B shows a perspective view of the insert after loading into the sleeve shown in FIG. 1.

FIG. 18A shows the intact sleeve, and FIG. 18B shows the sleeve after the breakaway locking tab has been removed.

DETAILED DESCRIPTION

Figure 1:
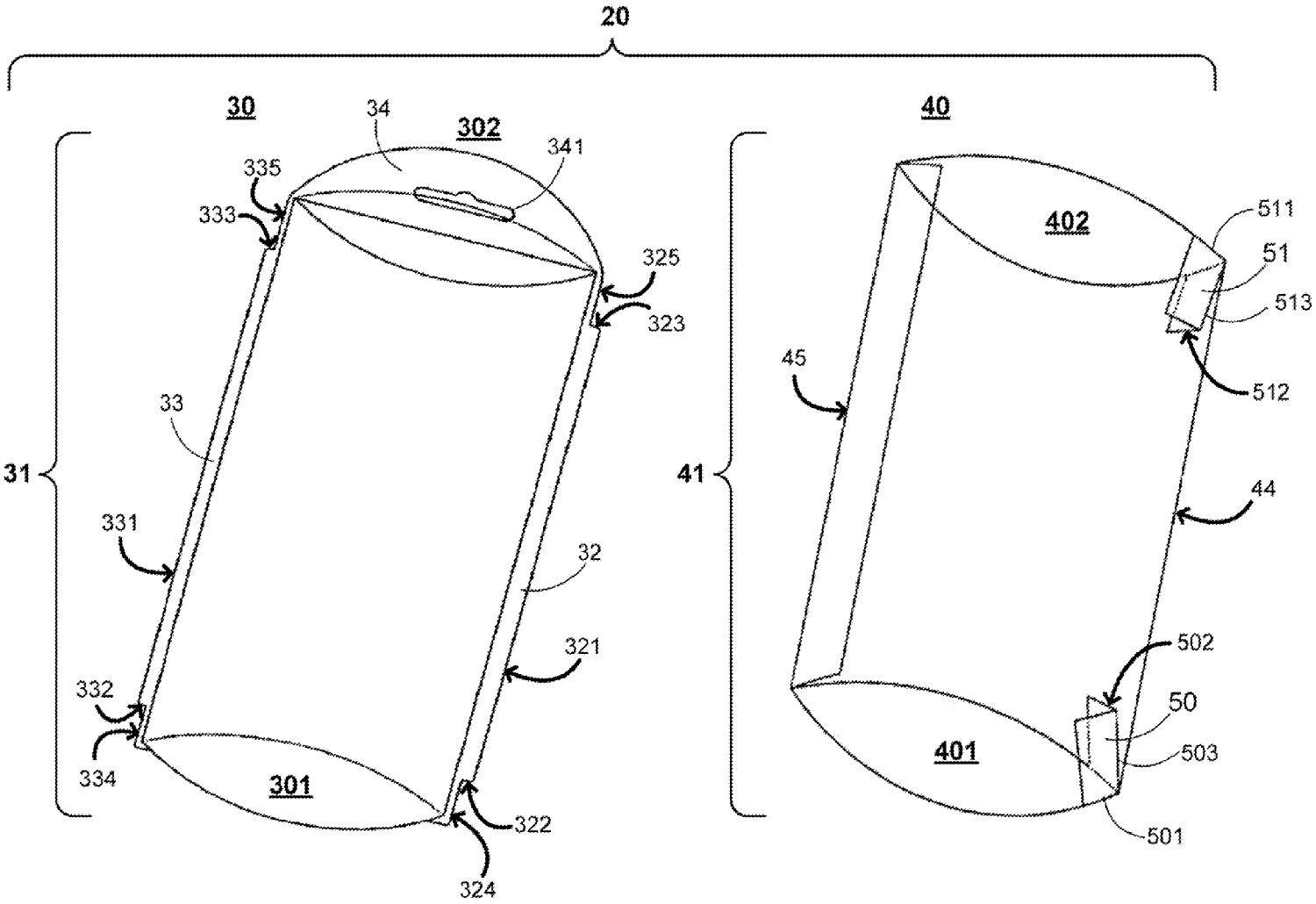
FIG. 1 shows a perspective view of the components of a sleeve-and-insert package according to an aspect of the invention.

Aspects of the invention are directed to sleeve-and-insert package designs in which the sleeve and insert lock together securely when the insert is loaded into the sleeve.

The package designs described herein offer easy loading and assembly, while providing a secure technique for holding the insert and product within the package. The interlocking aspect of the package makes it difficult to remove the insert without destroying or mutilating the outer sleeve, thus providing tamper resistance and tamper evidence for the contents. Further, the package designs provide a labor and material cost savings benefit, in that these designs do not require closing flaps or additional material such as adhesives, adhesive tape, labels, or the like, to securely retain the insert in the package. In addition, the described package designs can be implemented with a minimal impact on overall esthetic appearance. Also, the locking structures described herein are highly adaptable, and can be modified for use with different package geometries while maintaining a high degree of strength and security.

Various practices of invention are described in detail below, following a brief discussion with respect to the usage of a number of terms herein. Generally speaking, the words used herein are used in accordance with their usage in the packaging industry and related industries. The following discussion is provided in supplementation, rather than replacement, of that usage.

As used herein, the term "sleeve" refers to a tubular or tube-like packaging component, which can be open at both ends or at a single end. A sleeve is typically fabricated from one or more sheets of plastic, paperboard, cardboard, or other suitable material, or combination thereof that is assembled into a tubular or tube-like configuration. Generally speaking, it is desirable for the sleeve material to be substantially rigid and to be resiliently deformable. It will be appreciated that aspects of the present invention can also be practiced with different types of sleeves, including sleeves fabricated from different materials or combinations of materials.

As used herein, the term "insert" refers to a packaging component having a compartment, cavity, or the like, for holding an item to be packaged and having an outer shape that is configured to fit closely within a sleeve. An insert is loadable into an open end of the sleeve and is slidable down its length into a "loaded" configuration. An insert is typically fabricated from one or more sheets of plastic, paperboard, or cardboard, or other suitable material, or combination thereof, that is formed into a hollow structure having the desired compartment and outer shape. It will be appreciated that aspects of the present invention can also be practiced with inserts of different types, including inserts fabricated from different materials or combinations of materials, and inserts comprising a solid, rather than hollow, structure.

The assembling together of a sleeve and an insert can be equivalently described as sliding an insert into a sleeve, and sliding a sleeve over an insert. For the purposes of the present discussion, the assembly of the package is described in terms of sliding an insert into a sleeve.

As used herein, the terms "forward" and "forward direction" refer to the direction in which an insert travels when it is slid into a sleeve, and the terms "backward" and "backward direction" refer to the opposite direction. A "leading end" of an insert is an end of an insert that is inserted into a sleeve; the opposite end is referred to as the "trailing" end. Where an insert flange has more than one shoulder, the shoulder that is closer to the leading end is the "leading shoulder," and the shoulder that is closer to the trailing end is the "trailing shoulder." The "proximal end" of a sleeve is an end of a sleeve into which an insert is loaded; the opposite end is referred to as the "distal end." Where a sleeve has one or more locking tabs at both ends, the term "proximal locking tab" refers to the locking tab or tabs that are closer to the sleeve's proximal end, and the term "distal locking tab" refers to the locking tab or tabs that are closer to the sleeve's distal end.

As used herein, the term "longitudinal" refers to an orientation substantially in alignment with the path along which an insert travels within a sleeve. As discussed below, the path is not necessarily a straight line. The term "radial" refers to a direction extending radially outward from the center of a package, sleeve, or insert, substantially perpendicular to the path along which the insert travels within the sleeve. The term "horizontal" refers to a direction along a surface of the package, sleeve, or insert, that is substantially perpendicular to the path along which the insert travels within the sleeve.

As used herein, the adverb "substantially" is used inclusively. Thus, for example, depending upon the particular context in which it is used, the term "substantially rigid" can refer to a component that is completely rigid, as well as to a component that is not completely rigid, but that is sufficiently rigid to achieve a described result.

The term "or" is also used inclusively. Thus, unless immediately followed by a phrase such as "but not both," the phrase "A or B" includes: "A" by itself, "B" by itself; and both "A" and "B."

In addition, the recitation of a single element in the description of an exemplary practice of an invention is not intended to exclude additional such elements in alternative practices of the invention. Thus, for example, the use of the phrase "a flange" to describe an element in a depicted exemplary package according to the invention shall be understood, with respect to modifications or variations in the package design, to include packages having "one or more flanges" or "at least one flange."

There are now described a number of exemplary practices of the invention.

Figures 1A, 2:
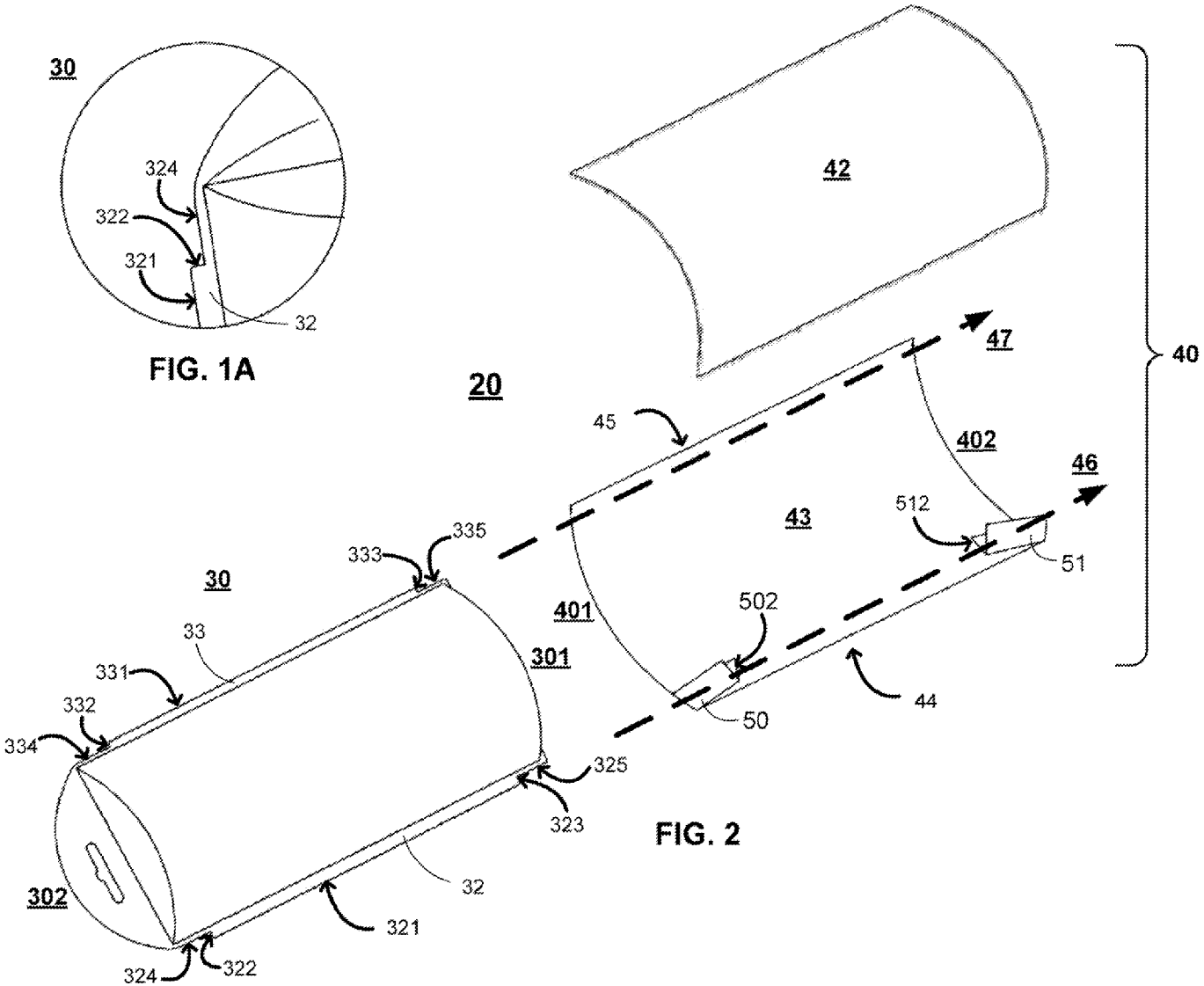
FIG. 1A shows a closeup view of a corner of the insert shown in FIG. 1.
FIGS. 2-4 show a series of perspective views of the insert and sleeve shown in FIG. 1, illustrating the loading of the insert into the sleeve and the operation of a locking feature therein.
Figure 3:
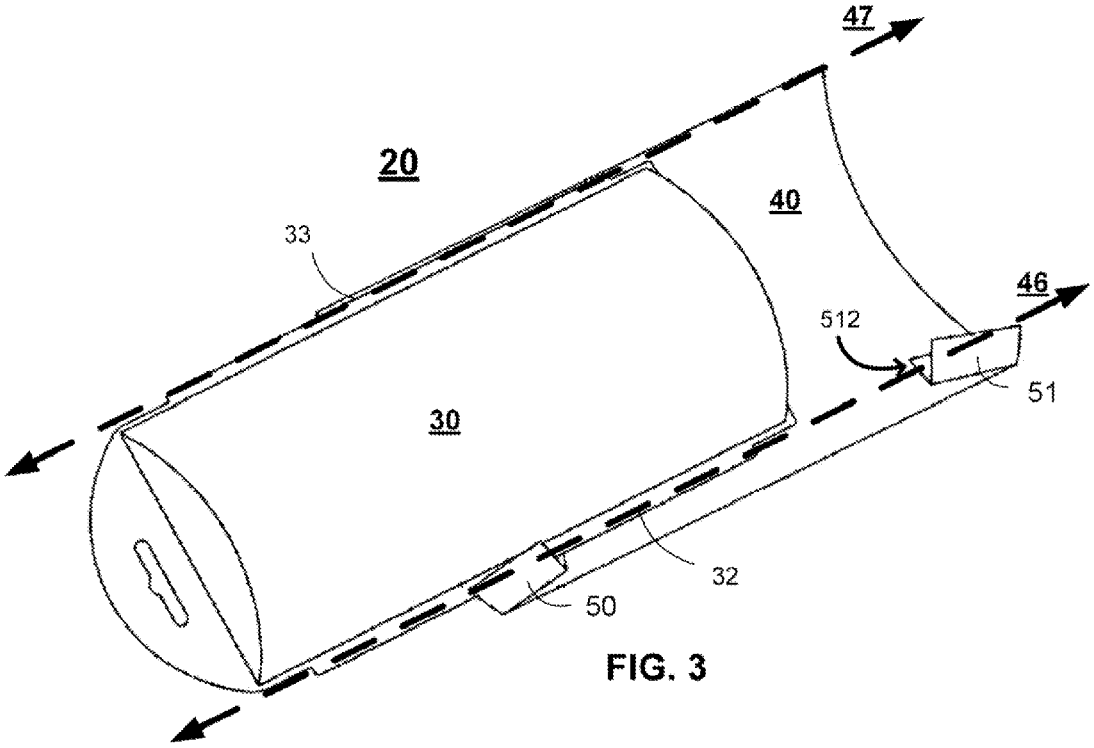
Figure 4:
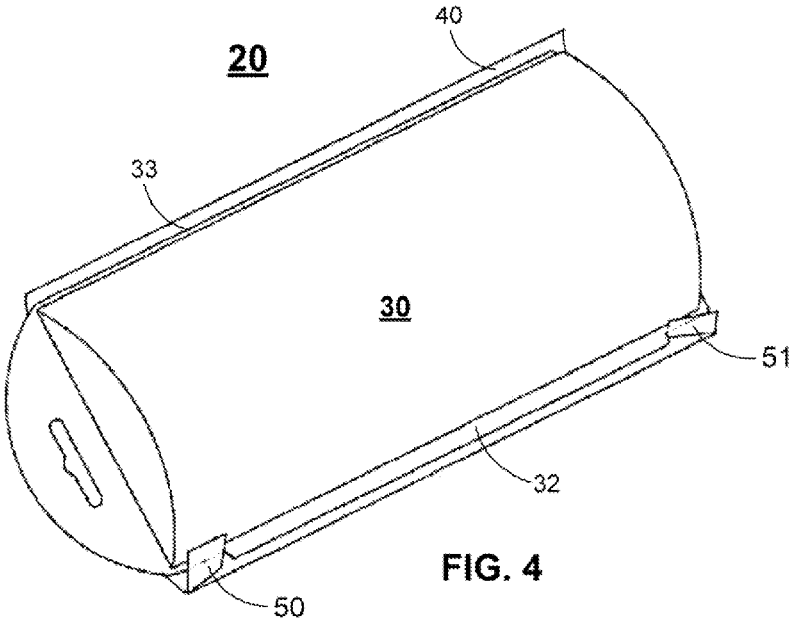

FIG. 1 shows a perspective view, prior to loading, of the components of a package 20, which comprises an insert 30 and a sleeve 40. FIG. 1A provides a closeup view of a corner of insert 30. FIGS. 2-4 are a series of perspective views illustrating the loading of insert 30 into sleeve 40, and the operation of the locking structures contained therein. It should be noted that in FIGS. 2-4, in order to provide an unobstructed view of the loading process, a panel of sleeve 40 has been cut away and a number of extraneous lines have been removed. Also, certain elements of package 20 described below may be seen more clearly in FIGS. 5A-5B, which provide a closeup view of a corner of sleeve 20, and FIGS. 6A-D, which provide an end view of insert 30 and sleeve 40.

As shown in FIGS. 1-6, insert 30 comprises an insert body 31 in which there is provided a compartment, cavity, or like structure (not shown) for holding a product to be packaged.

Insert 30 includes substantially rigid first and second flanges 32 and 33 that extend longitudinally along respective sides of the insert body 31. In the present example, first and second flanges 32 and 33 are substantially identical to each other and are symmetrically positioned at opposite sides of insert 31. However, as discussed below, it is possible to practice the invention using an insert having a different number or configuration of flanges, including for example an insert having a single flange, an insert having two or more flanges having different shapes, an insert having two or more flanges that are not symmetrically positions, or the like.

First flange 32 includes a deflector edge 321 that extends longitudinally along the length of the insert body 31. Deflector edge 321 terminates at first and second radially extending shoulders 322 and 323. Shoulders 322 and 323 terminate in a pair of flat edges 324 and 325 that extend in longitudinally towards the leading and trailing ends of the insert body 31. In FIGS. 1 and 2, shoulders 322 and 323 are shown as having a generally perpendicular relationship with deflector edge 321 and flat edges 324 and 325. This relationship can be modified, as desired. For example, it may be desired for the shoulders to form an acute angle with the flat edges. Further, it would be possible to practice the invention using a flange without flat edges, i.e., a flange in which the shoulders terminate at the surface of the insert body.

In the present example, second flange 33 is substantially identical to first flange 32, and includes edges corresponding to those of flange 32, i.e.: a deflector edge 331, a pair of shoulders 332 and 333, and a pair of flat edges 334 and 335.

The depicted exemplary insert 30 incorporates a so-called "clamshell" design. A clamshell-type insert is typically fabricated as a unitary structure, including integrally formed clamshell halves with a hinge therebetween. The clamshell halves are typically fabricated to include respective rims that line up with each other. When the clamshell halves are folded together, their respective rims combine to form a rim flange extending along the exterior of the assembled clamshell. The rim flange may extend all the way around the clamshell or only part of the way. In addition, the rim flange may include a number of distinct sections, including one or more separate longitudinal sections, each of which may provide a separate flange for locking the sleeve and insert together, as described herein.

It should be noted that the clamshell may be configured such that its hinge is positioned longitudinally along one side of the assembled insert, and forms part of the rim flange. Thus, the hinge may itself form part of the rim flange in the assembled clamshell.

According to an aspect of the invention, in a package employing a clamshell insert or other type of insert having a rim flange or like structure, the rim flange is used to form the described locking flanges. The flange shoulders can be formed by die-cutting. If the clamshell hinge forms some or all of a longitudinal section of the rim flange, the hinge can be used for forming a locking flange. Forming a locking flange from the clamshell hinge takes advantage of the fact that the hinge is typically the strongest part of a clamshell-type insert.

It should be noted that locking flanges suitable for use in the described locking system can be formed in other ways, using techniques known in the art. Thus, it is possible to practice the present invention using an insert that does not have a rim flange. It is further possible to practice the invention using an insert having a rim flange, but in which it is desired for whatever reason, to use one or more locking flanges that are independent of the rim flange.

Sleeve 40 comprises a tubular sleeve body 41 that includes a curved front panel 42 and a curved rear panel 43 that meet at edges 44 and 45 formed from creased score lines in the sleeve material. Edges 44 and 45 provide the respective vertices of first and second longitudinal channels 46 and 47 that along the length of sleeve body 41. First and second longitudinal channels 46 and 47 provide respective first and second longitudinal pathways for one or more correspondingly positioned flange or flanges extending outwardly from insert 30, discussed below. It will further be appreciated that the invention may also be practiced with other channel geometries that define one or more longitudinal paths extending down the length of a sleeve. Channel geometries that could be used in place of sharply creased edges 44 and 45 include, for example, a relatively tight curve, a box shape, or the like, which can be positioned at desired angular positions, in a regular or irregular configuration.

Exemplary sleeve 40 includes first and second open ends 401 and 402 having substantially identical sizes and shapes. It is noted that aspects of the invention may also be practiced with a sleeve in which the distal and proximal ends have different shapes or sizes. For example, it would be possible to use a sleeve that tapers from a broader proximal end to a narrower distal end. If a sleeve with non-identical ends is used, the sleeve is configured such that a suitable insert is loadable into at least one of the two ends.

In exemplary sleeve 40, because first and second open ends 401 and 402 are substantially identical, insert 30 can be loaded into sleeve 40 through either end. It should be noted that, in actual use, there may be a reason to prefer one end for loading rather than the other. Further, as discussed below, in alternative practices of the invention, sleeve 40 may include only a single open end.

As further shown in FIGS. 1 and 2, sleeve 40 includes a pair of locking tabs 50 and 51 that extend from the sleeve body 41 in line with longitudinal channel 46. Each of locking tabs 50 and 51 includes a respective contact edge 502 and 512. Locking tabs 50 and 51 are each foldable into the interior of the sleeve body 41 into a folded configuration in which the contact edges 502 and 512 are deflectably disposed along the longitudinal pathway defined by channel 46 in an orientation that is substantially perpendicular thereto.

FIGS. 3 and 4 illustrate the operation of the locking feature of package 20. As discussed above, the leading shoulder slides past the proximal in-folded tab without being engaged thereby and ultimately engages the distal in-folded tab, preventing the insert from sliding any further into the sleeve. In addition, the trailing shoulder slides over the proximal in-folded tab until it reaches a position at which it is engaged by the proximate locking tab contact edge prevent backward movement of the insert. In the present example, because of the spatial relationships between the locking tab contact edges and the flange shoulders, each of the leading and trailing shoulders engages its respective locking tab contact edge at approximately the same time.

In FIG. 3, insert 30 has been inserted partway into sleeve 40. First insert flange 32 is aligned with first sleeve channel 46, and second insert flange 33 is aligned with second sleeve channel 47. Because no locking tabs are provided at second sleeve channel 47, second insert flange 33 travels unimpeded along the length of the sleeve body 41. It should be noted that even though second insert flange 33 does not engage any locking tabs, it provides useful structural support for the insert body 31. In addition, the second insert flange 33 helps to prevent undesired rotation of the insert 30 within sleeve 40.

When insert 30 is first inserted into sleeve 40, the leading flat edge 324 and leading shoulder 322 of flange 32 pass over the first locking tab 50 without engaging contact edge 502. When the deflector edge 321 of flange 32 passes over the first locking tab 50, it causes the locking tab 50 to be deflected towards the inner surface of the sleeve body 41 without engaging contact edge 502. The deflection of locking tab 50 allows the insert 30 to move freely in a backwards and forwards direction.

The insert 30 is further slid along the length of sleeve 40 until its front end reaches second locking tab 51. The leading flat edge 324 passes over the second locking tab 51 without engaging contact edge 512.

The insert 30 is slid forward until the flange's leading shoulder 322 is engaged by the first locking tab's contact edge 502 and the flange's trailing shoulder 323 is engaged by the second locking tab's contact edge 512. The engagement of leading shoulder 322 with locking tab contact edge 502 prevents movement in the forward direction, i.e., in the direction of locking tab 50. The engagement of trailing shoulder 323 with second locking tab contact edge 512 prevents movement in the backward direction, i.e., in the direction of locking tab 51.

In package 20, a number of elements contribute to the strength of the locking action between insert 30 and sleeve 40, including the strength and stiffness of the insert flange and locking tabs.

With respect to the flange and shoulders on insert 30, it is noted that the flange of a standard or fold-over tray insert is its stiffest part. Positioning the flange and shoulders on the flange provides significantly greater strength and stiffness than that provided with other structures, such as indentations molded into the insert walls.

With respect to the locking tabs, it is noted that positioning a locking tab in-line with a crease and creasing the tab along its length dramatically increases its stiffness and locking strength by forming a bend in the tab when folded into the sleeve. The bend provides an "1-beam" structural effect to the locking tab, substantially reducing its deformability compared with non-creased tabs that extend from a sleeve panel. Because of the stiffness and strength of both the locking flange and the locking tabs, it is possible to achieve a firm locking action even when the locking elements are located only on one side, i.e., along a single crease in the assembled package. Prior art packages have typically required the use of locking elements on at least two opposite sides of the assembled package in order to achieve a strong and secure lock between an insert and a sleeve.

It should also be noted that a package according to the present invention, in which the locking elements are positioned along one or more crease lines, has the added benefit that the locking structures are generally unnoticeable to an untrained user. The locking tabs are relatively small and are tucked away in the corners of the package. Further, even in a package with locking structures at only one side, the locking action is sufficiently strong and sufficiently even that it is not immediately apparent where the locking structures are located. This aspect of described locking structures can thus provide improved security and esthetic appearance, compared with other locking arrangements in which the locking structures are more prominent.

Another advantage of the described locking system is that the locking flange is relatively easy to manufacture and modify. For example, one prior art design requires the molding of indentations into the front and rear panels of a package insert. It will be appreciated that it is significantly easier to achieve a precisely cut flange shoulder than it is to achieve a precisely molded indentation. Further, it is also significantly easier to change the location and shape of a die-cut flange shoulder than it is to change the shape and location of a molded indentation.

Depending upon the requirements of a particular package, it may be necessary to adjust the height of locking tab contact edges relative to the sleeve interior in order to ensure firm engagement between the locking tab contact edges and respective shoulders on the insert. According to a further aspect of the invention, the locking tabs are provided with a "bias," whereby the locking tabs tend to return to the desired height when they are not being deflected.

Figure 17:
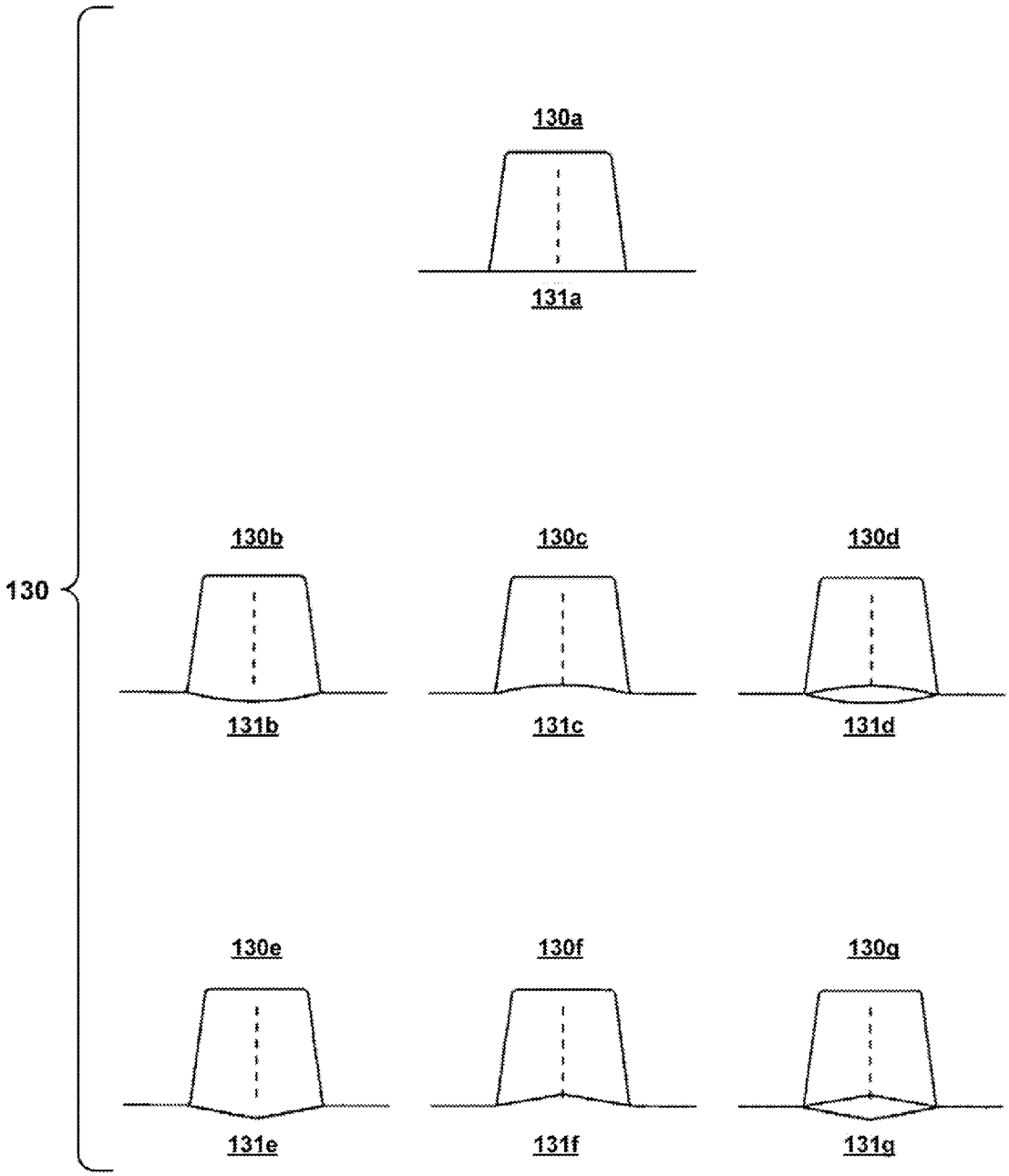
FIG. 17 shows a plan view of a number of locking tabs, illustrating alternative configurations for the horizontal creases at their respective bases.

A desired height for a locking tab contact edge can be achieved through the selection of a suitable shape for the horizontal folding crease at the base of the locking tab. A straight horizontal folding crease in line with the sleeve edge results in a locking tab having a relative low contact edge. The height of the contact edge can be increased by using a base crease that is suitably angled or curved. Examples of such creases are shown in FIG. 17, discussed below. Increasing the undeflected height of the contact edge can be used to create a more positive locking action.

With respect to biasing a locking tab to return to its undeflected height, it is noted that biasing may be provided by the resilience of the sleeve material. Thus, some biasing may be provided by a tendency of an in-folded tab to unfold. In addition, the deflection of the locking tab may result in part from an overall deformation of the sleeve cross section (e.g., a slight increase in the height of the sleeve and a slight decrease in its width). In that case, a bias will be provided by the tendency of the sleeve to return to its undeformed shape.

Figure 5A:
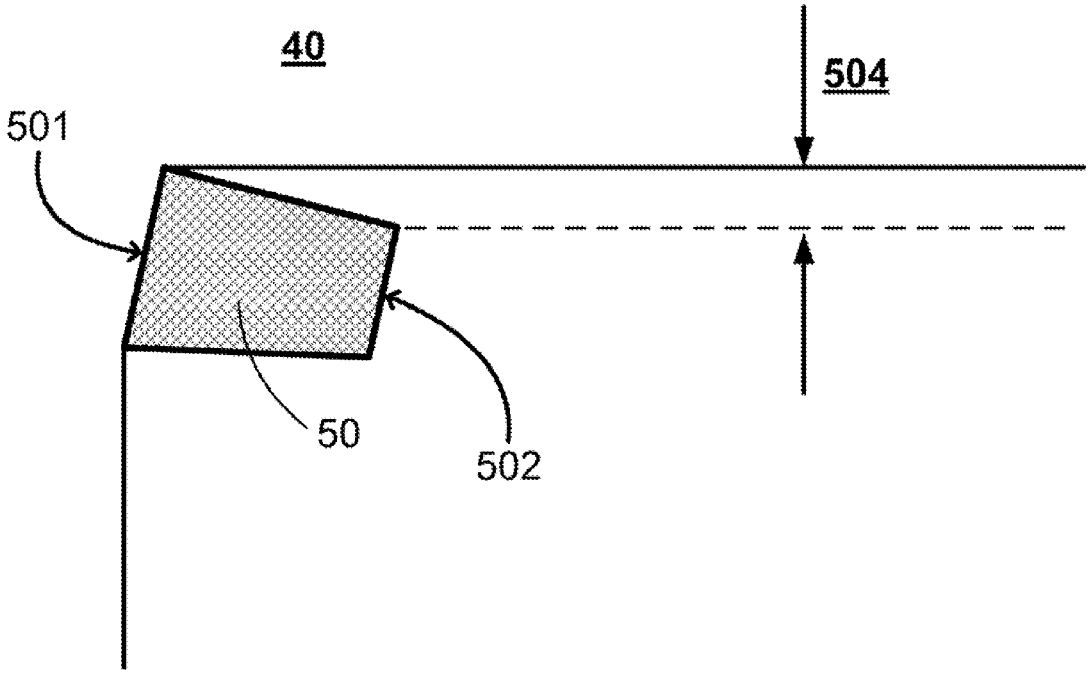
FIGS. 5A and 5B are a pair of diagrams illustrating the starting and deflected positions of a locking tab in an exemplary practice of the invention.
Figure 5B:
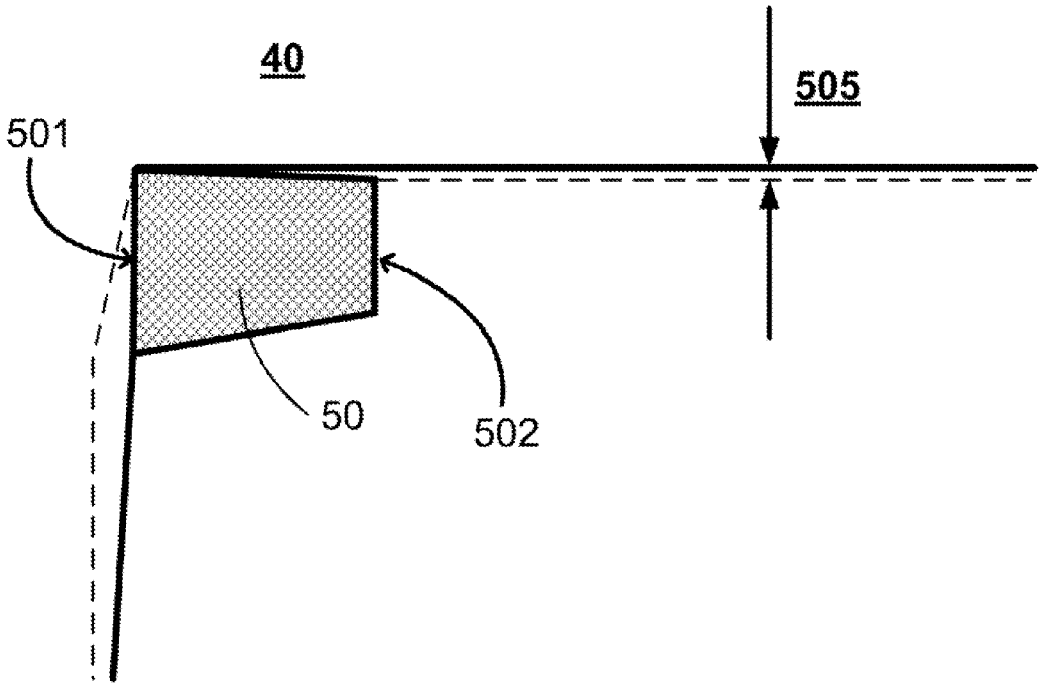

FIGS. 5A and 5B show a cross section diagram, not drawn to scale, of a corner of sleeve 40 illustrating the deflectability and biasing of folded-in locking tab 50. Locking tab 50 has a slanted horizontal crease 501 at its base, resulting in a slanted section at the sleeve opening proximate to the sleeve edge. The amount of slant has been exaggerated for the purposes of clarity. In actual use, the amount of slant can be reduced to the point that it is unnoticeable by a typical customer.

As shown in FIG. 5A, locking tab 50 has a contact edge 502 with a desired undeflected height 504 suitable for engagement with a corresponding shoulder. FIG. 5B shows the locking tab 50 in its deflected position, with a deflected height 505 that positions the contact edge close enough to the sleeve interior to allow the insert flange to freely ride over the locking tab 50 without engaging the contact edge 502. The deflection of the locking tab pulls at the top edge of the sleeve 40, causing it to deform slightly. Because the sleeve 40 is fabricated from a resiliently deformable material, the top edge of the sleeve will tend to return to its undeflected position, thereby tending to cause the locking tab to also return to its undeflected position.

Figure 6D:
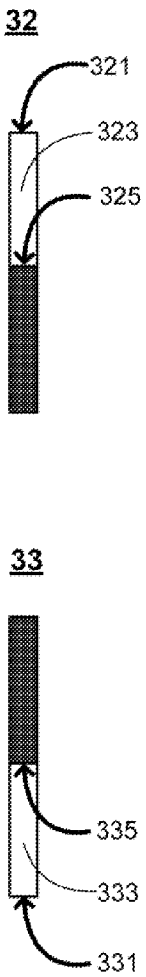
FIG. 6D shows an end view, not drawn to scale, of the flanges extending from the insert shown in FIGS. 6A-6C.
Figure 6C:
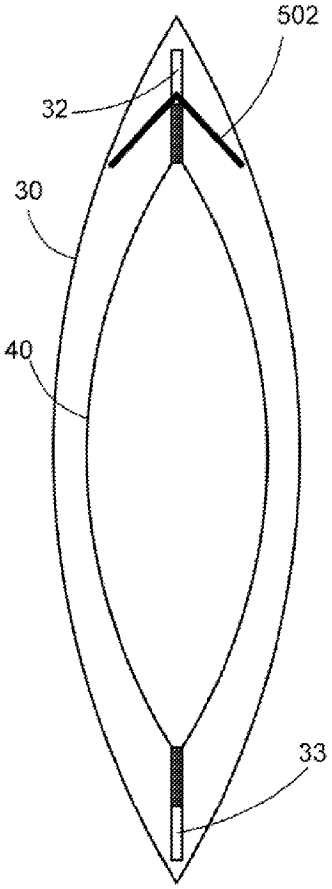
FIGS. 6A-6C are a series of diagrams illustrating the deflection of the locking tab contact edges as the insert is advanced within the sleeve.
Figure 6B:
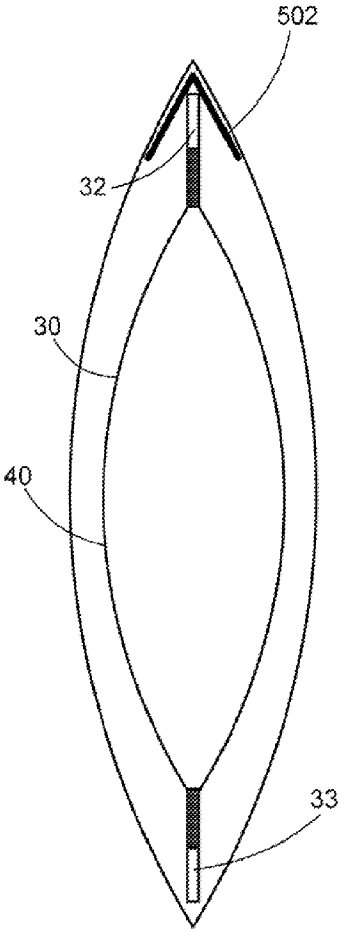
Figure 6A:
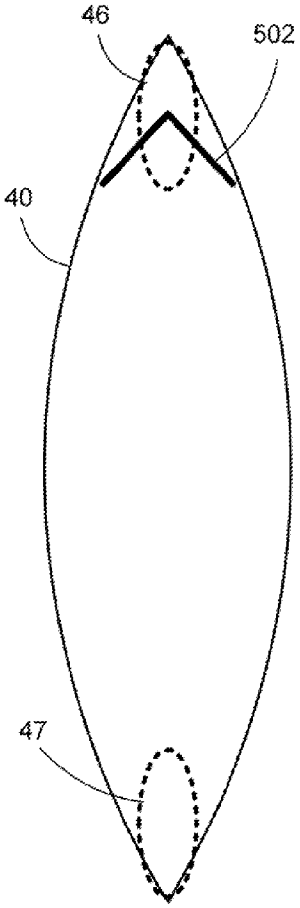

FIGS. 6A-C are a series of cross section diagrams, not drawn to scale, further illustrating the operation of the described sleeve locking tab and insert flange. FIG. 6D shows an end view, not drawn to scale, of flanges 32 and 33.

FIG. 6A shows a cross section diagram of sleeve 40, illustrating a pair of longitudinal channels 46 and 47 and the contact edge 502 of a folded-in locking tab (not shown). FIG. 6B shows a cross section diagram of sleeve 40, into which there has been loaded partway an insert having first and second flanges. In FIG. 6B, the deflector edge has deflected the locking tab into a "low" position, allowing the insert to be freely moved in both directions. In FIG. 6C, the deflector edge no longer deflects the locking tab. The biasing force described above urges the locking tab contact edge toward the flat edge of the flange, such that the locking tab contact edge is engaged by the shoulder.

It will be appreciated from the above description that the described locking feature may be employed with different numbers and configurations of flanges and locking tabs. For example, extra tabs and flanges can be provided, depending upon the desired amount of insert retention. Extra tabs and flanges can be provided along the same longitudinal channel or along different longitudinal channels. Also, if locking is only desired in a forward or in a backward direction, it would be possible to practice the invention using only a single locking tab and respective shoulder.

Further, in package 20, insert 30 and sleeve 40 have substantially the same length. Insert flange 32 is configured such that the locking tab contact edges engage the insert flange shoulders when the ends of the insert 30 line up with the ends of the sleeve 40. It would also be possible to practice aspects of the invention using an insert and sleeve having different lengths. For example, the insert could be shorter than the sleeve. In that case, the location of the locking tabs could for example be modified such that they extend, not from the ends of the sleeve, but rather from respective locations within the sleeve interior that line up with the ends of the insert. Such alternative locations for the locking tabs could also be used in conjunction with a package in which the insert and sleeve have substantially identical lengths.

Further, in insert 30, the first and second flanges 32 and 33 are shown as separate elements. It would also be possible to practice the invention with a single flange that extends around the top or bottom of the insert body.

It should further be noted that package 20 has a "straight" shape, in which the insert 30 travels along a substantially straight path with sleeve 40. It will be appreciated that the locking feature described herein may also be used in package with non-straight shapes including, for example, packages in which the insert travels along a path that is curved, helical, or otherwise nonlinear. Thus, as used herein, the term "longitudinal" refers to an orientation in line with the path along which the insert travels, which may not necessarily be a straight line.

Also, in FIGS. 1-6, exemplary package 20 is depicted as having a cross sectional profile that is generally lenticular (i.e., shaped like a double convex lens). From the present discussion, it will be apparent that a package according to the present invention can be made in any of an infinite number of cross-sectional shapes, as desired. These include traditional shapes, such as pillow packs, rectangles, triangles, squares, and the like, but are not limited to these shapes.

There are now discussed techniques for fabricating packaging components that incorporate the locking structures described herein.

According to an aspect of the invention, a sleeve of the type described above is fabricated from one or more sheets of plastic, paperboard, or cardboard, or a combination thereof, that is trimmed and scored to form a blank that is then assembled into the desired form.

Figure 7B:
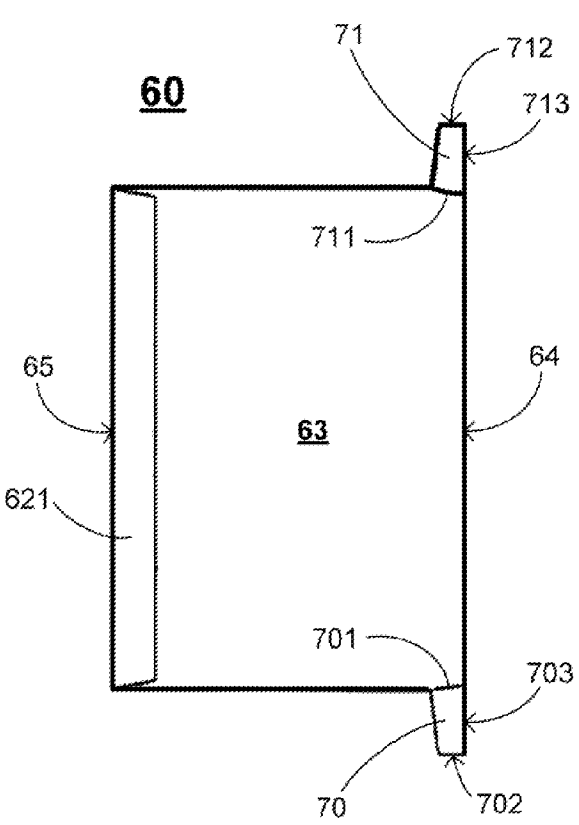
FIGS. 7A and 7B show, respectively, unassembled and assembled views of a sleeve blank that can be used to fabricate the sleeve shown in FIG. 1.
Figure 7A:
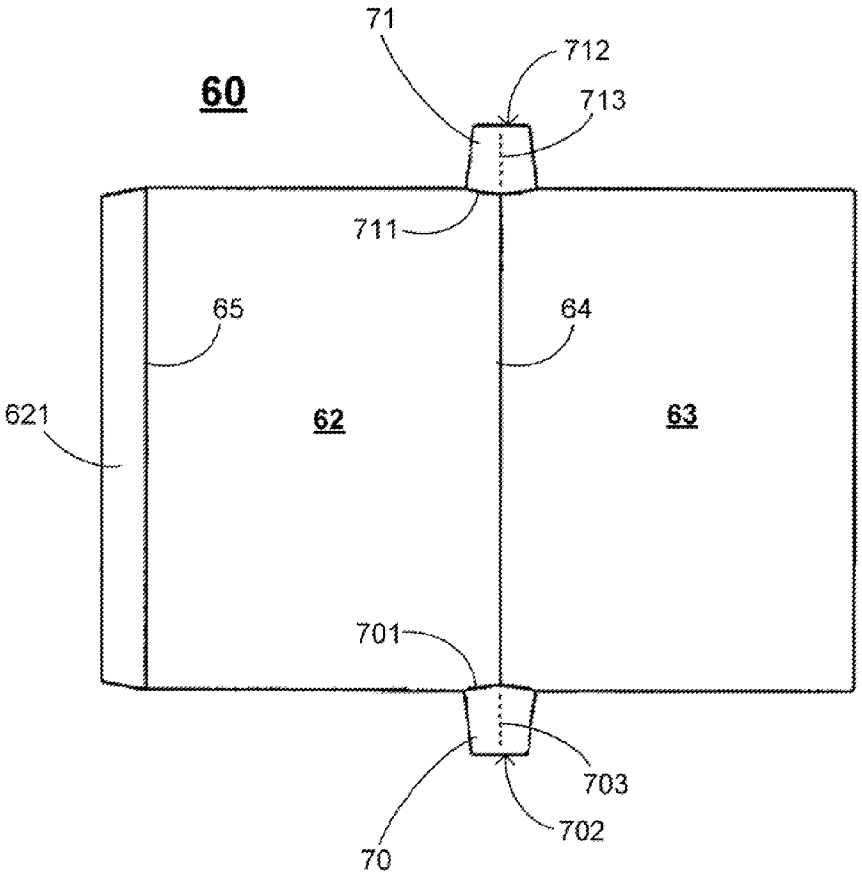

FIGS. 7A and 7B show, respectively, unassembled and assembled views of a blank 60 that can be used to fabricate the sleeve 40 shown in FIG. 1. Blank 60 is oriented to provide a view of its "interior" surfaces, i.e., those surfaces that form the interior surfaces of the finished sleeve 40. Blank 60 includes the following elements created by die-cutting and scoring:

first blank panel 62, corresponding to first sleeve panel 42;

second blank panel 63, corresponding to second sleeve panel 43;

an assembly flap 621, extending from first blank panel 62, which is attached to second blank panel 63 to close sleeve 40;

first crease 64, corresponding to first edge 44;

second crease 65, corresponding to second edge 45;

first blank tab 70, horizontal folding crease 701, contact edge 702, and longitudinal crease 703, corresponding respectively to proximal locking tab 50, crease 501, contact edge 502, and crease 503; and first blank tab 71, horizontal folding crease 711, contact edge 712, and longitudinal crease 713, corresponding respectively to proximal locking tab 51, crease 511, contact edge 512, and crease 513.

Figure 13:
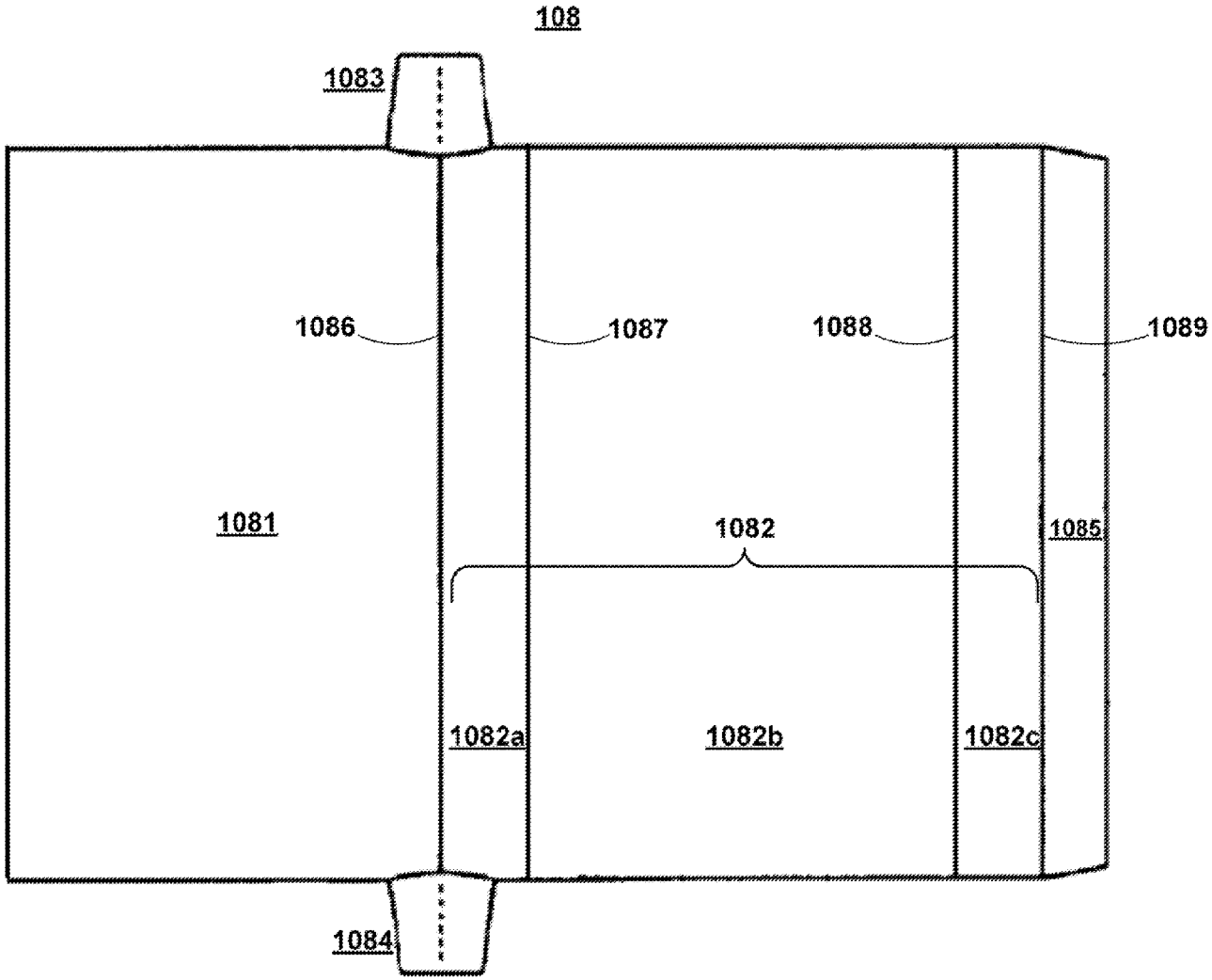

The base of blank tab 70 is defined by base crease 701, which is substantially perpendicular to creases 64 and 703. The base of blank tab 71 is defined by base crease 711, which is substantially perpendicular to creases 64 and 713. As shown in FIG. 13, discussed below, the base creases 701 and 711 can have a number of different configurations. Also, the base creases 701 and 711 can have non-identical configurations.

As shown in FIG. 7A, blank tab 70 is substantially bisected by longitudinal crease 703 extending therethrough, substantially aligned with sleeve crease 64. Similarly, blank tab 71 is substantially bisected by longitudinal crease 713 extending therethrough, substantially aligned with sleeve crease 64.

As discussed below, packaging sleeves and inserts are typically provided by business entities that are separate and distinct from the business entities that use the sleeves and inserts to create finished, loaded packages for retail sale. Thus, a packaging sleeve, such as sleeve 60, will typically be assembled initially into a configuration that has a substantially flat profile, for shipping purposes, and that can be easily reconfigured for loading.

FIG. 7B shows blank 60, after it has been assembled into a flat configuration for shipping purposes. Panels 62 and 63 have been folded together at score line 64, and flap 621 has been folded at score line 65 and adhered to a corresponding surface on panel 63 to form a flattened tube. Tabs 70 and 71 are folded longitudinally in half along score lines 703 and 713, and protrude out of the ends of the flattened tube. When a closely fitting insert is loaded into the sleeve, panels 62 and 63 conform to the outer perimeter of the insert to achieve the desired final sleeve profile.

Figure 8A:
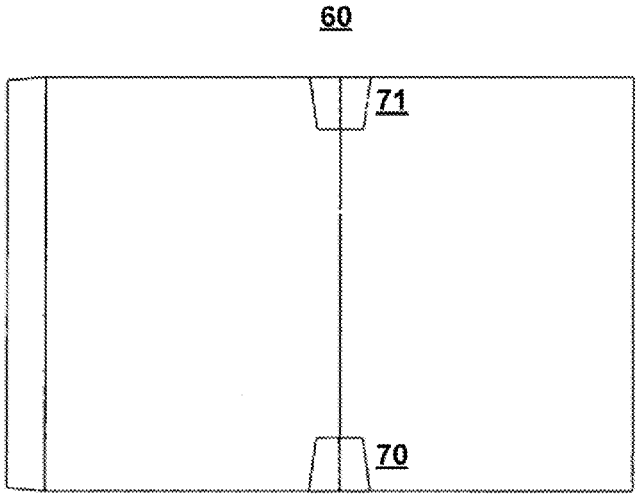
FIGS. 8A and 8B show, respectively, unassembled and assembled views of the sleeve blank of FIG. 7, in which the locking tabs have been folded inward.
Figure 8B:
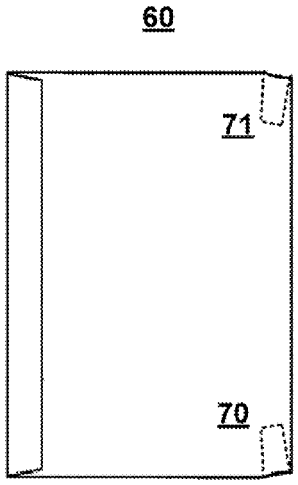

According to a further practice of the invention, tabs 70 and 71 are in-folded prior to assembly. FIGS. 8A and 8B show, respectively, unassembled and assembled views of blank 60, with in-folded tabs 70 and 71. It will be seen that, in the FIG. 8B configuration, tabs 70 and 71 do not protrude from the ends of the assembled blank 60.

It is noted that in the FIG. 7B configuration, the folding direction of tabs 70 and 71 at longitudinal score lines 703 and 713 is the same as that of panels 62 and 63 at score line 64. In the FIG. 8B configuration, the folding direction of tabs 70 and 71 at longitudinal score lines 703 and 713 is the opposite of that of panels 62 and 63 at score line 64.

Folding blank tabs 70 and 71 along creases 703 and 713 substantially increases their rigidity, and greatly enhances the above described locking feature. When folded in, the tabs each have generally V-shaped profile, and present generally V-shaped contact edges 702 and 712.

The blank 60 is assembled into a sleeve by folding the blank along crease lines 64 and 65 and then attaching flap 621 to a corresponding surface on the back panel 63. Flap 621 can be attached to panel 63 by gluing, welding, or like technique. Panels 62 and 63 arc initially flat, but are curved into their final lenticular shape as they conform to a suitably shaped insert loaded therein, such as insert 30 shown in FIGS. 1-6.

In typical practice, a packaging provider will ship the assembled sleeves to a manufacturer as flattened tubes. Depending upon the manufacturer's requirements, the flattened tubes can be shipped with the locking tabs not folded in, or folded in. If the sleeves are to be shipped with the locking tabs folded in, the locking tabs can be folded in using a folding machine or by hand prior to the gluing of flap 621 to panel 63.

Although unusual, it would also be possible for a packaging provider to ship raw blanks to the manufacturer.

Blank 60 can be shipped in a number of different configurations. For example, it can be shipped as shown in FIG. 7B. Alternatively, it can be shipped with locking tabs 70 and 71 folded in, using a folding machine or by hand. It would further be possible to fold the blank along creases 64 and 65, attach flap 621 to panel 63, and ship the assembled sleeve 40 as a flattened tube.

Figure 9:
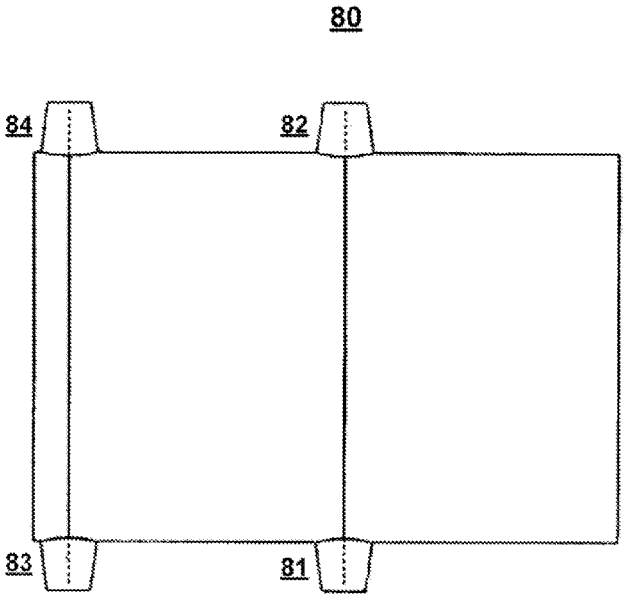
FIG. 9 shows a plan view of a sleeve blank, similar to the blank shown in FIG. 7, that has been provided with two sets of locking tabs.

As discussed above, it is possible to practice aspects of the invention using a sleeve with additional locking tabs. FIG. 9 shows a diagram of a blank 80 including both a first set of locking tabs 81 and 82, and a second set 83 and 84.

In the current example, the sleeve has a generally lens-shaped cross sectional shape. However, the shape doesn't have to be perfect, because it's manufactured from a resiliently deformable material. Thus, it will conform to the outer circumference of the insert.

Figure 10A:
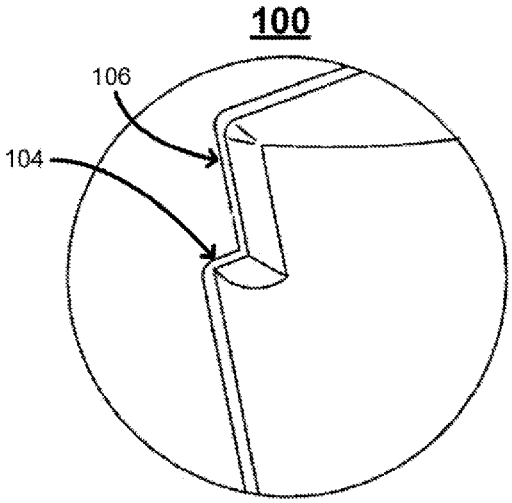
FIG. 10 shows a perspective view of a tray-type insert that has been provided with a longitudinal flange and shoulders in accordance with a further aspect of the invention.
Figure 10:
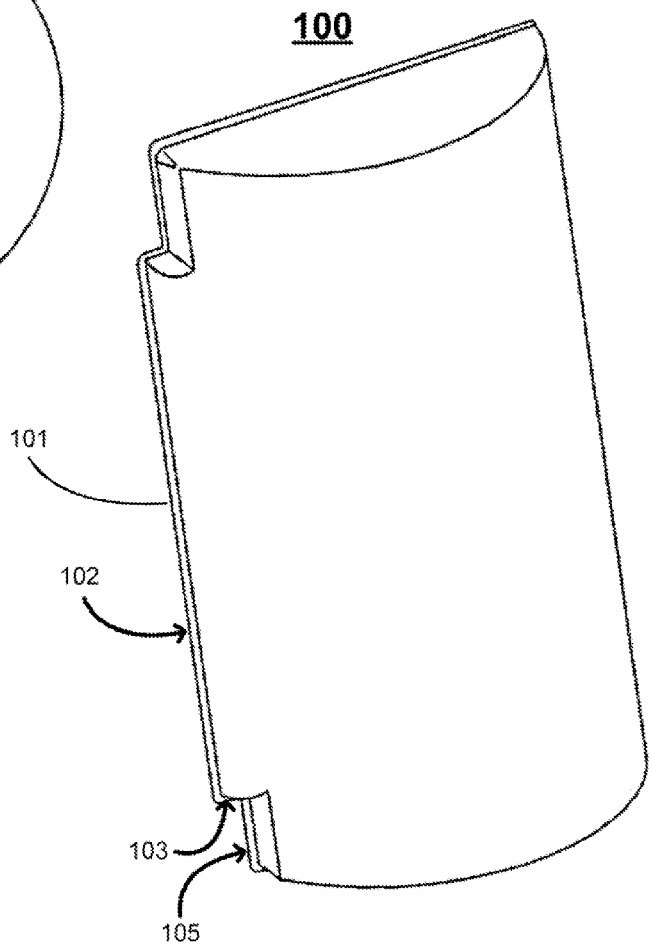

The insert 30 shown in FIG. 1 is a fold-over, clamshell-type insert. FIG. 10 shows a perspective view of a tray-type insert 100 according to a further aspect of the invention. Insert 100 has an outer perimeter that fits closely within a sleeve of the type shown in FIGS. 14A-14C, discussed below.

Insert 100 includes a longitudinal flange that 101 lines up with a corresponding channel within the sleeve. Flange 101 includes a deflector edge 102, shoulders 103 and 104, and flat edges 105 and 106. One or more additional flanges (not shown) can be added to the insert 100. As discussed above with respect to the clamshell insert 30 shown in FIG. 1, these additional flanges may be substantially identical to flange 101, but may also be different.

Insert 100 can be formed in a number of different ways using different types of materials. For example, the "tray" component of insert 100 can be thermoformed from one or more sheets of a suitable plastic. An insert tray is typically fabricated to include a flat surrounding edge, generally similar to the rims in a clamshell design, as discussed above. Thus, the flange 101 can be formed from the flat surrounding edge. The flange edges 102-106 can be formed using die-cutting, molding, or other suitable technique, or combination thereof.

It will be seen that insert 100 has a cross section profile with a different shape than that of insert 30 shown in FIG. 1. Whereas insert 30 has a lenticular profile with substantially identical, symmetrically disposed front and back panels, the cross section profile of insert 100 is substantially shaped like a circle segment, with a flat panel on one side and an arcuate panel on the other.

Figure 11:
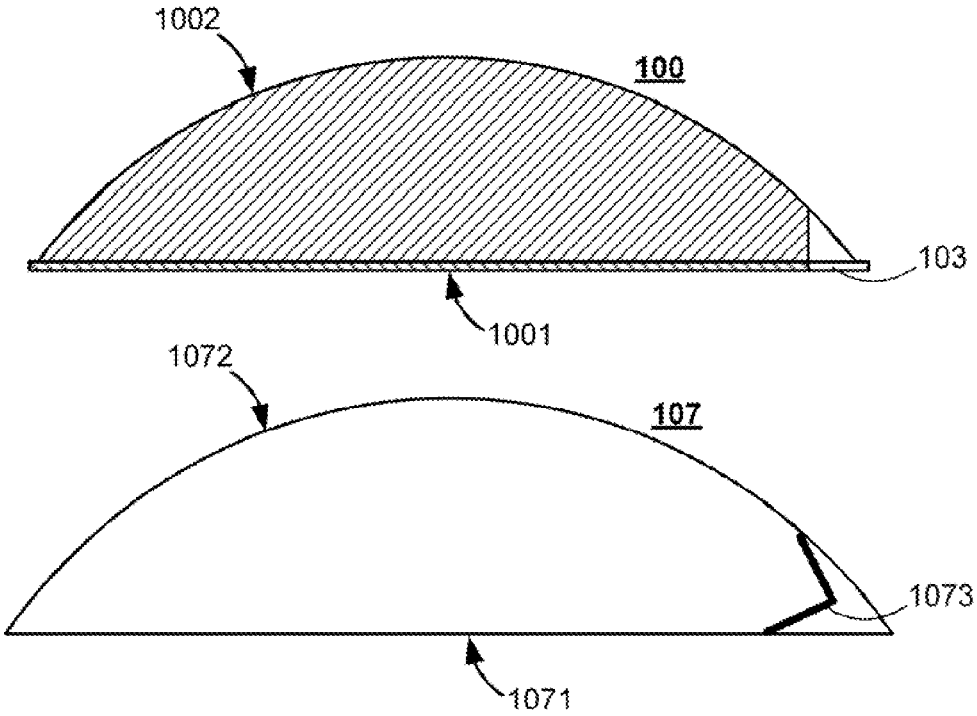
FIGS. 11-14 are a series of diagrams illustrating a sleeve, in accordance with a practice of the invention, suitable for use with the insert shown in FIG. 10.
Figure 12:
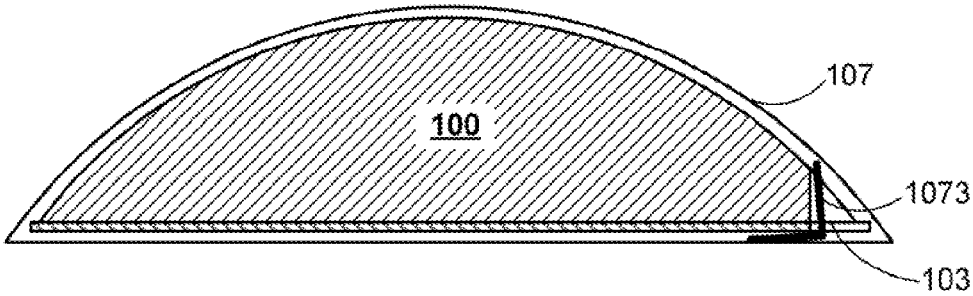

FIG. 11 shows a side view of insert 100 and a sleeve 107 according to a further aspect of the invention. Sleeve 107 includes a flat bottom panel 1071 and an arcuate top panel 1072 corresponding in shape to the flat panel 1001 and arcuate panel 1002 of insert 100. Further shown is a locking tab contact edge 1073 that engages with insert shoulder edge 103 to provide the above-described locking feature. FIG. 12 shows a side view of the locked insert 100 and sleeve 107.

Sleeve 107 illustrates the adaptability of the invention to different package shapes. As is apparent in FIG. 11, the sleeve's bottom panel 1071 and top panel 1072 are not identical. Rather, panel 1072 has a width that is significantly greater than that of bottom panel 1071.

The reason that this difference in width is significant is that, as mentioned above, packaging sleeves are almost invariably shipped to a manufacturer as flattened tubes. Thus, if a sleeve design includes non-identical opposing panels, the sleeve design must be configured in a way that allows the sleeve to be flattened.

FIG. 13 shows a sleeve blank 108 satisfying the above criteria. Blank 108 includes a first panel 1081 corresponding to flat sleeve panel 1071. Arcuate panel 1072 is provided by three separate panels 1082*a-c*. Locking tabs 1083 and 1084 are provided at the top and bottom of blank 108. Glue flap 1085 is attached to a corresponding surface on panel 1081 to form the blank 108 into a tube. Panels 1081, 1082*a-c*, and 1085 are defined by score lines 1086-1089.

Panel 1081 is configured to have the same width as panel 1082*b*, and panel 1082*a* is configured to have the same width as panel 1082*c*. It will be seen that when flap 1085 is affixed to panel 1081, panels 1081 and 1082*a-c* have a cross section profile that substantially approximates a parallelogram that can then be flattened.

Figure 14A:
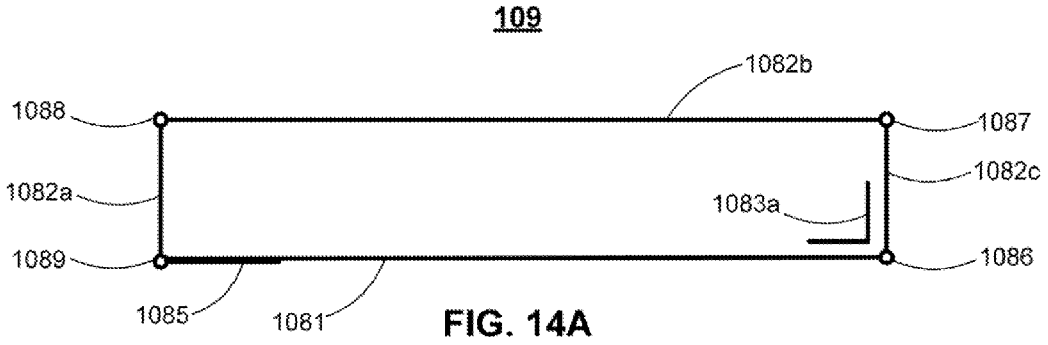
Figure 14B:
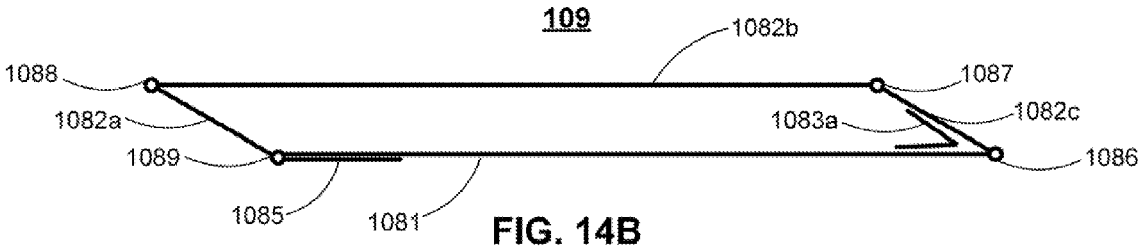
Figure 14C:
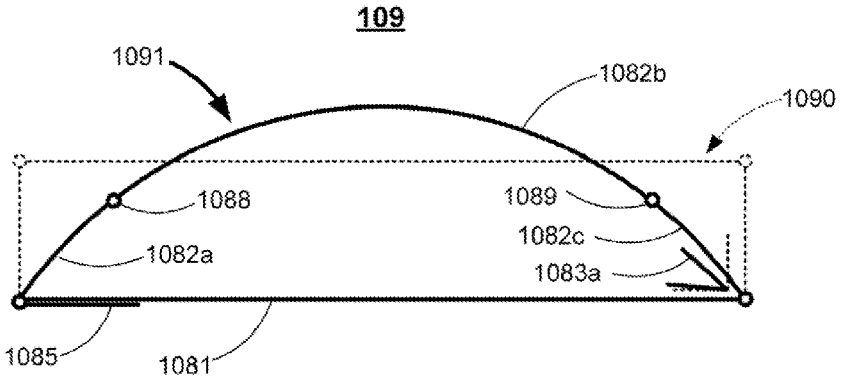

FIGS. 14A-14C are a series of diagrams illustrating the changes in the shape of the sleeve profile.

FIG. 14A shows a side view of the tube 109 formed when flap 1085 is glued, or otherwise attached, to panel 1081. For the purposes of illustration, tube 109 is shown in FIG. 14A as having a cross section profile with a rectangular shape. In actual practice, however, tube 109 will typically have a cross section profile with a flattened parallelogram shape.

FIG. 14B shows how tube 109 is flattened by (1) positionirig adjacent pairs of panels 1081/1082*c* and 1082*a*/1082*b* to form respective acute angles at score lines 1086 and 1088, and (2) positioning adjacent pairs of panels 1081/1082*a* and 1082*b*/1082*c* to form respective obtuse angles at score lines 1087 and 1089.

FIG. 14C shows tube 109, after being reshaped to have a profile corresponding to that of sleeve 107 shown in FIGS. 11 and 12. For purposes of comparison, there is also depicted using dotted lines a rectangular tube profile 1090 corresponding to the profile shown in FIG. 14A. As shown in FIG. 14C, after reshaping, panels 1082*a-c* and score lines 1088 and 1089 merge into a substantially continuous, single arcuate panel 1091 corresponding to sleeve panel 1072 shown in FIG. 11.

According to a further aspect of the invention, a locking package is configured such that the insert can be partially slid out of the sleeve without completely disengaging therefrom. This feature is useful, for example, for packaging applications where closer examination of or access to the contents while in the retail environment may be required, but where it is desirable that the sleeve and insert remain connected.

FIG. 15A shows a perspective view of an exemplary insert 110, similar to insert 30 shown FIG. 1, that can be used in provide a partial opening feature. Insert 110 includes a flange 111 having a deflector edge 112, closely spaced first and second shoulders 113 and 114, and first and second flat edges 115 and 116. In the present example, insert 110 includes a second flange 117 that is substantially identical to the flanges 32 and 33 in insert 30 shown in FIG. 1.

FIG. 15B shows a perspective view of exemplary insert 110 loaded into the sleeve 40 shown in FIG. 1. When the insert 110 is located at a first locking position within sleeve 40 at which leading shoulder 113 engages with distal locking tab 51, movement of insert 110 is prevented in the forward direction. Similarly, when the insert 110 is located at a second locking position within sleeve 40 at which the trailing shoulder edge 114 engages with proximal locking tab 50, movement of insert 110 is prevented in the backward direction. Because of the relatively close spacing of shoulders 113 and 114, it will be seen that between the first and second locking locations, there is a range of locations 118 in which the insert is movable in both a forward and a backward direction. In the present location, the leading shoulder edge 113 is positioned with respect to the distal locking tab 51 such that, when the insert is at the first locking location, the ends of the insert line up with the ends of sleeve 40. The trailing shoulder edge 114 is positioned with respect to proximal locking tab 50 to create a second locking location at a desired distance from the first locking location.

It will be appreciated that the opening feature shown in FIGS. 15A and 15B can be flipped around so that the shortened flange 111 is located proximate to the hang tab. In this configuration, the package is partially openable by sliding sleeve 40 in an upward direction. The arrangement of the locking tabs and the flange prevent the sleeve from sliding downward when the package is loaded onto a display hook.

It will be seen that the configuration shown in FIG. 15B is substantially similar to the package 20 shown in FIGS. 1-6. However, in package 20, both shoulders 322 and 323 engage their respective locking tabs 50 and 51 at substantially the same time, resulting in a range of movement having substantially zero length.

It should further be noted that package 110 provides a convertibility feature between the fixed locking arrangement shown in FIGS. 1-6 and the ranged locking arrangement shown in FIGS. 15A-15B. Package 110 can be converted between the two types of locking arrangements by rotating the insert and sleeve relative to each other around the longitudinal axis by an angle of 180 degrees. It will be seen that this rotation changes which of flanges 111 and 117 are engaged by locking tabs 50 and 51.

Figure 16:
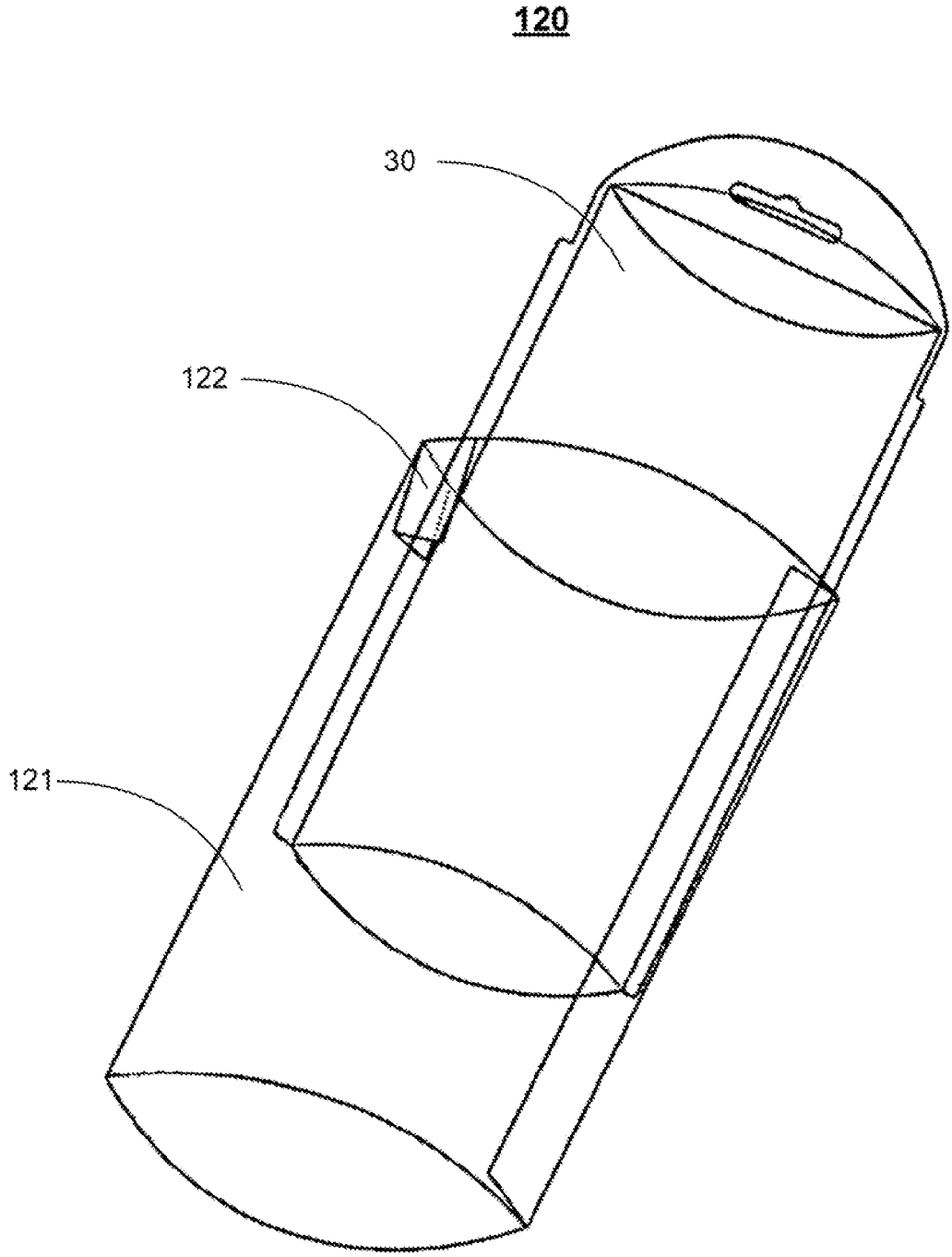
FIG. 16 shows an insert and sleeve, similar to the insert and sleeve shown in FIG. 1, in which the sleeve is provided with a single locking tab.

FIG. 16 shows a perspective view of an exemplary package 120 according to another aspect of the invention. Package 120 is provided with locking tabs and shoulders at just one end of the sleeve. This type of package provides a locking feature only in one direction. Positioning the locking tab 122 at the top of the package 120 prevents the sleeve 121 from sliding down off the insert 30. Sleeve 121 is removable by sliding it in an upward direction.

Package design 120 could also be used, for example, in conjunction with a sleeve having only one open end. In that case, locking would only be required in a single direction, since the closed end of the sleeve would serve to prevent movement of the insert in the other direction.

FIG. 17 shows a series of tabs 130*a-g* having different types of horizontal base creases 131*a-g*. As discussed above, modifying the shape of the base crease affects the height of the contact edge of an undeflected locking tab. Tab 130*a* has a straight base crease 131*a*; tabs 130*b-d* have curved base creases 131*b-d*, and tabs 130*e-g* have angled base creases 131*e-g*.

A further aspect of the invention provides an "easy-open" feature for a locking sleeve-and-insert package of the type described above. The easy-open feature allows a customer to open a package with relatively little effort, while allowing the sleeve to remain intact.

In one practice of the invention, the easy-open feature is implemented by modifying the above-described sleeve component, which can then be used in conjunction with the above-described insert component.

Figure 18A:
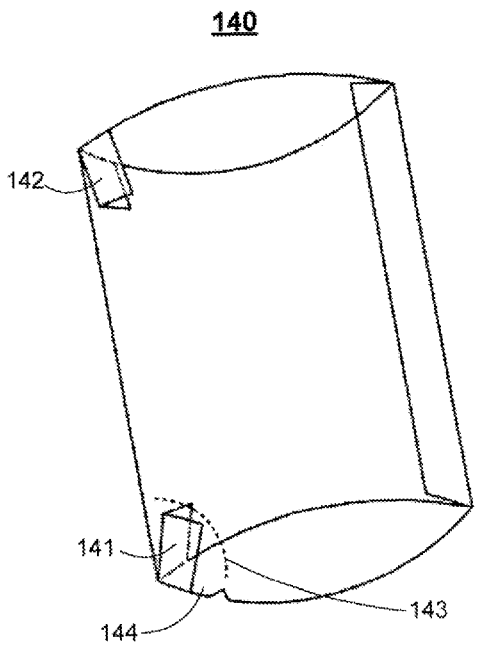
FIGS. 18A and 18B show perspective views of a sleeve that has been perforated to provide a breakaway locking tab according to a further practice of the invention.

FIG. 18A shows a perspective view of an assembled sleeve 140 incorporating an easy-open feature according to an aspect of the invention. Sleeve 140 is a modified version of the sleeve 40 shown in FIG. 1, and includes a pair of infolded locking tabs 141 and 142 at its lower and upper ends. To facilitate opening of the package by a consumer, the sleeve 140 is provided with an arch-shaped die cut perforation 143 that defines a breakaway section 144 surrounding the bottom locking tab 141. The perforation 143 is cut to allow a customer to grip and tear loose the breakaway section 144, thereby disabling the bottom locking tab 141. It would also be possible to provide a second perforation defining a second breakaway section for disabling the upper locking tab 142.

Figure 18B:
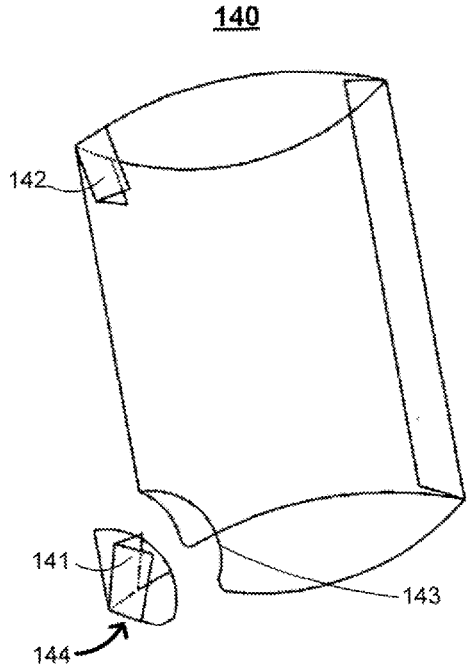

FIG. 18B shows a perspective view of the sleeve 140 after the arch-shaped breakaway section 144 has been detached from the sleeve body. It will be seen that removal of the bottom locking tab allows an insert to be removed through the bottom sleeve opening.

The breakaway section 144 is designed to be sufficiently small and unobtrusive such that the sleeve 140 remains intact after detachment. Thus, the sleeve is reusable by the customer, who can reload the insert into the bottom of the sleeve to reclose the package, as desired.

The breakaway section 144 can be implemented using different shapes and sizes. In addition, respective breakaway sections having the same or different shapes and sizes can be provided for more than one locking tab, or even for all locking tabs in a given package.

Figure 19:
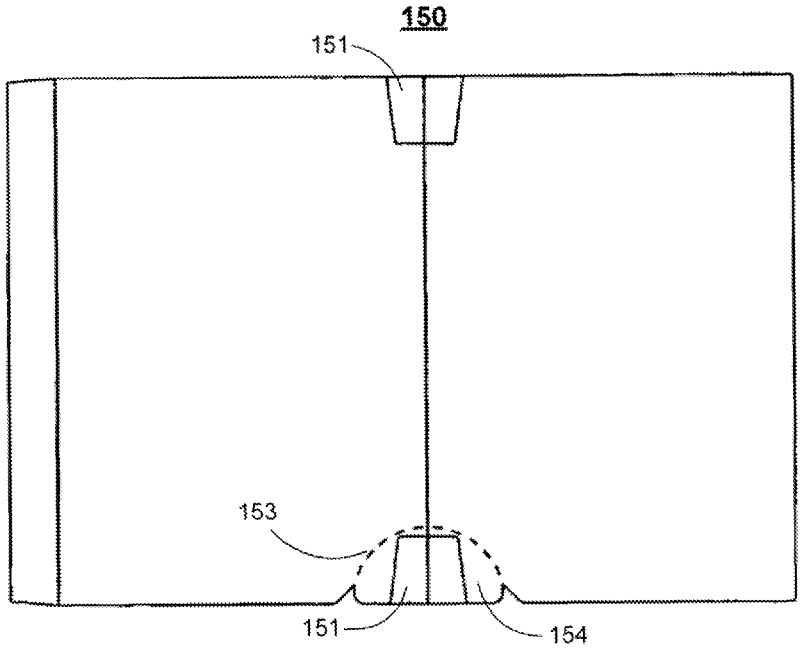
FIG. 19 shows a plan view of a sleeve blank, in which the locking tabs have been infolded, that can be used to assemble the sleeve shown in FIGS. 18A and 18B.

FIG. 19 shows a plan view of a blank 150, in which the locking tabs have been infolded, that is suitable for fabricating the sleeve shown in FIGS. 18A and 18B. Blank 150 includes locking tabs 151 and 152 and perforation 153 corresponding to tabs 141 and 142 and perforation 143 in the assembled sleeve. Blank 150 and assembled sleeve 140 may be freely modified in accordance with the above-described aspects of the invention. These modifications may include, for example: changing the number, location, or configuration of locking tabs, changing the shape of the assembled sleeve, and the like.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A package, comprising:

an insert;

an insert flange extending along a side of the insert, the insert flange including a shoulder;

a sleeve having an open end, wherein the sleeve fits closely around the insert and includes a longitudinal channel providing a longitudinal path along the length of the sleeve for receiving the insert flange; and a locking tab extending from the sleeve in line with the longitudinal channel, wherein the locking tab is foldable into the sleeve to present a contact edge extending across the longitudinal path, such that the insert is loadable into the sleeve to a position in which the insert flange shoulder is engageable with the contact edge of the locking tab, so as to prevent movement of the insert in the direction of the locking tab, wherein the locking tab includes a base defined by a horizontal crease, wherein the horizontal crease results in a selected height, relative to the sleeve interior, for the contact edge of the folded-in locking tab.

2. The package of claim 1, wherein the horizontal crease is angled.

3. The package of claim 1, wherein the horizontal crease is curved.

4. A package, comprising:

an insert;

an insert flange extending along a side of the insert, the insert flange including a shoulder;

a sleeve having an open end, wherein the sleeve fits closely around the insert and includes a longitudinal channel providing a longitudinal path along the length of the sleeve for receiving the insert flange; and a locking tab extending from the sleeve in line with the longitudinal channel, wherein the locking tab is foldable into the sleeve to present a contact edge extending across the longitudinal path, such that the insert is loadable into the sleeve to a position in which the insert flange shoulder is engageable with the contact edge of the locking tab, so as to prevent movement of the insert in the direction of the locking tab, wherein the sleeve includes a first locking tab at a first end, and a second locking tab at a second end, and wherein the insert flange includes a first shoulder that is engageable by the contact edge of the first locking tab, and a second shoulder that is engageable by the second locking tab, such that engagement between the first shoulder and the contact edge of the first locking tab prevents movement in the direction of the first locking tab, and such that engagement between the second shoulder and the contact edge of the second locking tab prevents movement in the direction of the second locking tab, thereby securing the insert within the sleeve.

5. The package of claim 4, wherein the first shoulder and second shoulder are spaced sufficiently close together to allow the insert to be slid partway out of an end of the sleeve before engagement at that end between a shoulder and a contact edge of a locking tab.

6. A package, comprising:

an insert;

an insert flange extending along a side of the insert, the insert flange including a shoulder;

a sleeve having an open end, wherein the sleeve fits closely around the insert and includes a longitudinal channel providing a longitudinal path along the length of the sleeve for receiving the insert flange;

a locking tab extending from the sleeve in line with the longitudinal channel, wherein the locking tab is foldable into the sleeve to present a contact edge extending across the longitudinal path, such that the insert is loadable into the sleeve to a position in which the insert flange shoulder is engageable with the contact edge of the locking tab, so as to prevent movement of the insert in the direction of the locking tab; and deactivation means for deactivating the locking tab, thereby allowing movement in the direction of the deactivated locking tab.

7. The package of claim 6, wherein the deactivation means comprises a breakaway section defined by a perforation around the locking tab, wherein removal of the breakaway section removes the locking tab from the package.

8. A packaging sleeve, comprising:

at least one sheet of a creasable, resiliently deformable material that is formed into a sleeve body having at least one open end, wherein the sleeve fits closely around a packaging insert and includes a longitudinal channel along its length that provides a longitudinal path for a longitudinal flange extending along the length of the packaging insert, wherein the formed sleeve further includes a locking tab extending from the sleeve in line with the longitudinal channel, wherein the locking tab is foldable into the sleeve into a configuration in which it presents a deflectable contact edge extending across the longitudinal path, wherein the locking tab has a horizontal crease at its base that is configured to create a selected height, relative to the sleeve interior, for the contact edge of the locking tab.

9. The packaging sleeve of claim 8, wherein the horizontal crease is angled.

10. The packaging sleeve of claim 8, wherein the horizontal crease is curved.

11. A packaging blank, comprising:

at least one sheet of a creasable, resiliently deformable material having defined sections therein such that the sheet is formable into a packaging sleeve, wherein the sheet is formable into a sleeve having an open end, wherein the sleeve fits closely around a packaging insert and includes a longitudinal channel along its length providing a longitudinal path for a longitudinal flange extending along the length of the packaging insert, wherein the formed sleeve further includes a locking tab extending therefrom in line with the longitudinal channel, wherein the locking tab is foldable into the sleeve into a configuration in which it presents a deflectable contact edge extending across the longitudinal path, wherein the locking tab comprises a longitudinal crease therein that is aligned with the longitudinal sleeve crease, and wherein the locking tab has a horizontal crease at its base that is configured to create a selected height, relative to the sleeve interior, for the contact edge of the locking tab.

12. The package of claim 11, wherein the horizontal crease is angled.

13. The package of claim 11, wherein the horizontal crease is curved.

* * * * *